US006527633B1

(12) United States Patent
Tank et al.

(10) Patent No.: US 6,527,633 B1
(45) Date of Patent: Mar. 4, 2003

(54) ABRASIVE BODY

(76) Inventors: Klaus Tank, 9 Warbleton Avenue, Essexwold, Bedfordview (ZA), 2007; Roy Derrick Achilles, 608 San Martinho, Leicester Road, Bedfordview (ZA), 2007

( * ) Notice: Subject to any disclaimer, the term of this patent is extended or adjusted under 35 U.S.C. 154(b) by 0 days.

(21) Appl. No.: 09/743,257

(22) PCT Filed: Jul. 1, 1999

(86) PCT No.: PCT/IB99/01231

§ 371 (c)(1),
(2), (4) Date: Feb. 5, 2001

(87) PCT Pub. No.: WO00/01918

PCT Pub. Date: Jan. 13, 2000

(30) Foreign Application Priority Data

Jul. 6, 1998 (ZA) ..... 98/5923

(51) Int. Cl.[7] ..... B23F 21/03

(52) U.S. Cl. ..... 451/548; 451/530; 451/539; 451/540; 438/612

(58) Field of Search ..... 451/548, 530, 451/539, 540; 438/612

(56) References Cited

U.S. PATENT DOCUMENTS

| | | | | | |
|---|---|---|---|---|---|
| 5,484,330 | A | * | 1/1996 | Flood et al. | 175/428 |
| 5,486,137 | A | * | 1/1996 | Flood et al. | 175/428 |
| 5,711,702 | A | * | 1/1998 | Devlin | 175/428 |
| 6,071,182 | A | * | 6/2000 | Sunagawa | 451/296 |
| 6,169,021 | B1 | * | 1/2001 | Akram et al. | 438/106 |

FOREIGN PATENT DOCUMENTS

| | | |
|---|---|---|
| EP | 0 356 097 A | 2/1990 |
| EP | 0 604 211 A | 6/1994 |
| GB | 2 302 893 A | 2/1997 |

* cited by examiner

*Primary Examiner*—Joseph J. Hail, III
*Assistant Examiner*—Alvin J Grant
(74) *Attorney, Agent, or Firm*—Oblon, Spivak, McClelland, Maier & Neustadt, P.C.

(57) ABSTRACT

An abrasive body which includes an abrasive layer bonded to a substrate along an interface and at least one projection extending from the interface into the substrate. The a projection has an essentially elliptical or circular form in plan and a profile which includes a substantially flat central portion and connecting surfaces joining the central portion to the interface and which slope towards the interface.

7 Claims, 2 Drawing Sheets

ABRASIVE BODY

BACKGROUND OF THE INVENTION

This invention relates to an abrasive body and more particularly to an abrasive body which can be used as a tool insert.

Composite abrasive compacts are products used extensively as inserts for abrasive tools such as drill bits. Such composite abrasive compacts comprise an abrasive compact layer bonded to a cemented carbide support. The abrasive compact will typically be a diamond abrasive compact, also known as polycrystalline diamond or PCD, or a cubic boron nitride compact, also known as polycrystalline CBN or PCBN.

Composite abrasive compacts are manufactured under elevated temperature and pressure conditions, e.g. diamond or cubic boron nitride synthesis conditions.

As it is known that PCD composite compacts contain considerable residual stresses as a result of the high temperature/high pressure conditions used in their manufacture. Further, methods of mounting such compacts into drill bits, for example press fitting or brazing, can modify the stress distributions in the compacts. Additional stresses are imposed on the compacts during their use in applications such as drilling. Stresses may be introduced into the interface between the abrasive compact layer and the cemented carbide support. These stresses may be reduced or modified by providing a recess which extends into the cemented carbide support from the compact/carbide interface and which is filled with the abrasive compact. In the prior art, the recess has taken various shapes such as a plurality of concentric rings, a V-shaped recess, a cross-shaped recess, and a recess which incorporates a number of steps. A purpose in most of such designs is to reinforce and support the cutting edge by providing overall rigidity for the composite compacts.

U.S. Pat. No. 5,472,376 describes a tool component comprising an abrasive compact layer bonded to a cemented carbide substrate along an interface. A recess extends from the interface into the substrate and is filled with abrasive compact. The recess has a stepped configuration and is located entirely within the carbide substrate.

EP 356097 describes a tool insert comprising an abrasive compact bonded to a cemented carbide substrate. The abrasive compact is located in a recess formed in the substrate. The abrasive compact has a top surface which provides a cutting edge for the tool insert, a bottom surface complimentary to the base of the recess and a side surface at least partially located in the recess, the portion of the side surface located in the recess being complimentary to the side of the recess. The side surfaces may be sloping.

SUMMARY OF THE INVENTION

According to the present invention, an abrasive body, for use, for example, as a tool insert, comprises an abrasive layer bonded to a substrate along an interface and at least one abrasive projection extending from the interface into the substrate, the projection having an essentially elliptical or circular form in plan and a profile which includes a substantially flat central portion and surfaces to either side thereof which slope towards the interface.

The projection may lie wholly within the outer surface of the body or may have a portion or section coincident therewith. Two or more such projections may be provided.

DESCRIPTION OF EMBODIMENTS

The abrasive body may have various shapes, but is preferably right circular cylindrical.

The substrate layer will typically be a cemented carbide substrate layer. The cemented carbide of the substrate may be any known in the art such as cemented titanium carbide, cemented tungsten carbide, cemented tantalum carbide, cemented molybdenum carbide, or mixtures thereof. As is known, such cemented carbides will typically have a binder content of 3 to 30% by mass. The metal binder will typically be cobalt, iron or nickel or an alloy containing one or more of these metals.

The abrasive layer will generally be an abrasive compact layer or a layer of diamond produced by chemical vapour deposition (CVD). When the abrasive layer is an abrasive compact layer, it will preferably be a diamond compact layer or a cubic boron nitride compact layer.

Figure 1:
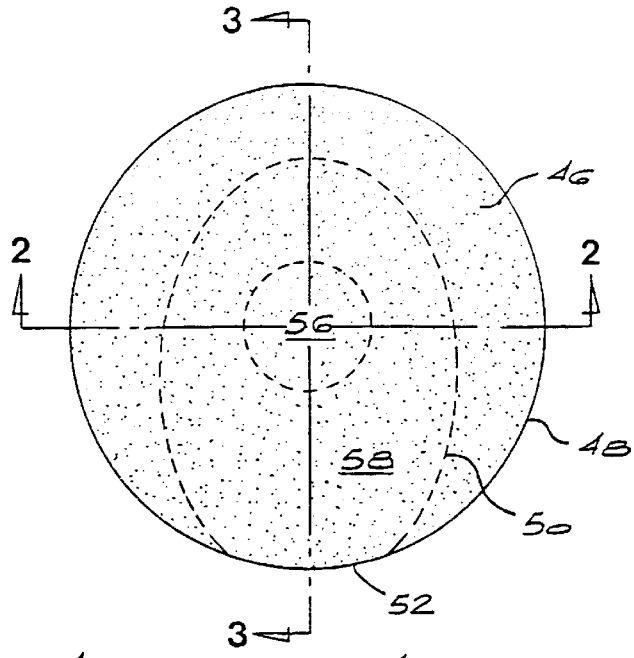
FIG. 1 is a plan view of a first embodiment of the invention.

An embodiment of the invention will now be described with reference to FIGS. 1 to 3. Referring to these figures, an abrasive body comprises a layer of abrasive compact 40 bonded to a substrate 42, particularly a cemented carbide substrate, along an interface 44. The surface 46 of the abrasive compact layer 40 provides an abrasive surface for the body, while the peripheral edge 48 provides a cutting edge, remote from the interface.

An abrasive compact projection 50 extends from the interface 44 into the substrate 42. This projection has essentially an elliptical shape in plan, as can be seen from FIG. 1. Further, an edge surface 52 is coincident with a side surface of the abrasive body. In use, the peripheral edge 48 of this region of coincidence will be used as the cutting edge.

Figure 2:
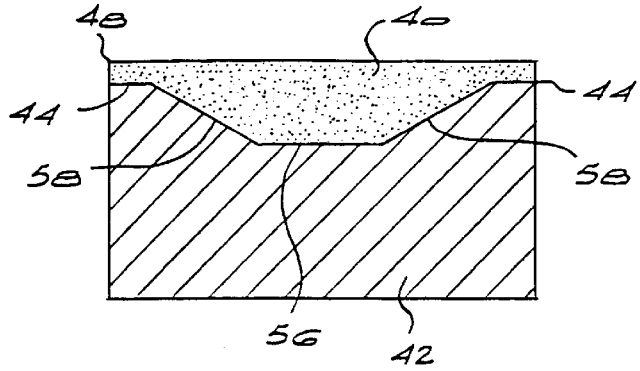
FIG. 2 is a section along the line 2—2 of FIG. 1.
Figure 3:
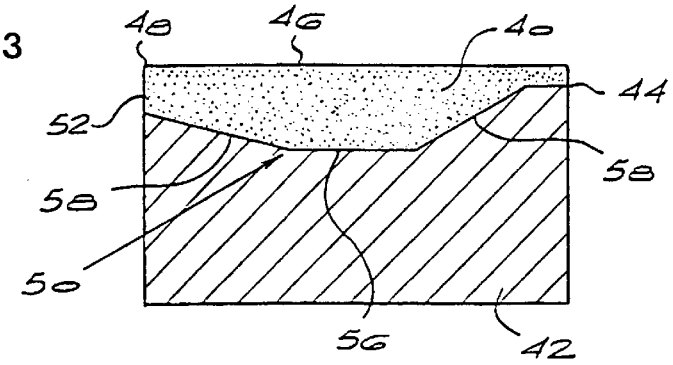
FIG. 3 is a section along the line 3—3 of FIG. 1.

The profile of the projection is illustrated from different directions by FIGS. 2 and 3. It will be noted from these figures that the profile is such that there is a central flat section 56 and surfaces 58 which slope from this central section 56 to the interface 44.

Figure 5:
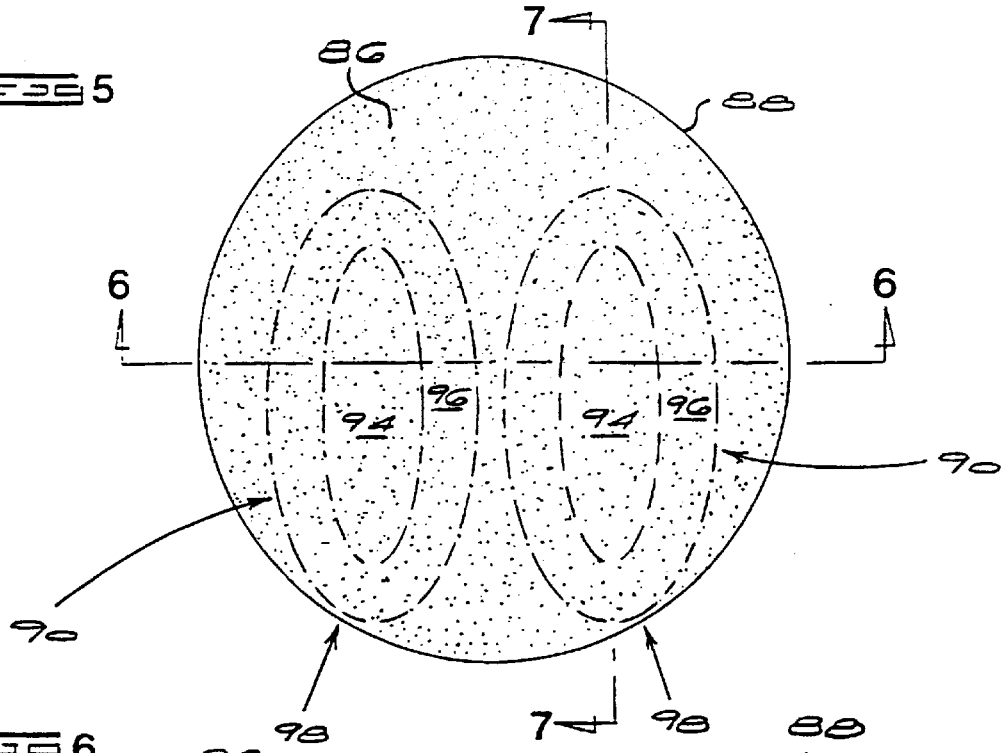
FIG. 5 is a plan view of a further embodiment of the invention.
Figure 6:
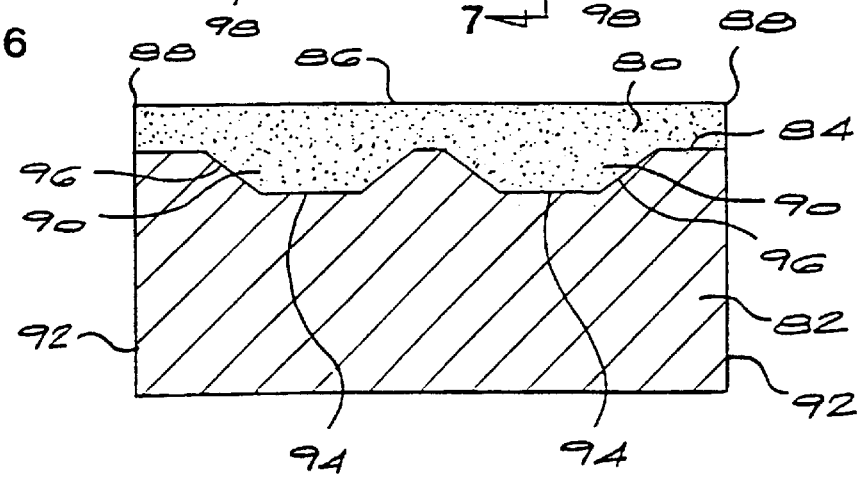
FIG. 6 is a section along the line 6—6 of FIG. 5.
Figure 7:
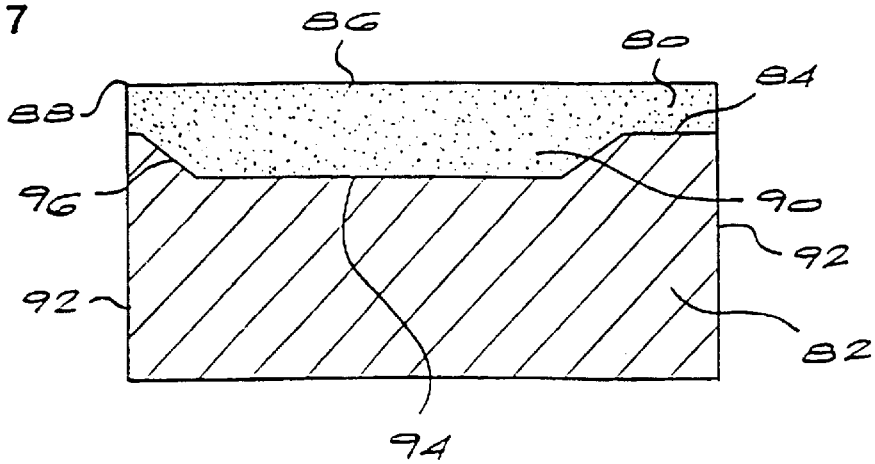
FIG. 7 is a section along the line 7—7 of FIG. 5.

A further embodiment of the invention will now be described with reference to FIGS. 5 to 7. Referring to these figures, an abrasive body comprises a layer of abrasive compact 80 bonded to a substrate 82, particularly a cemented carbide substrate, along an interface 84. The surface 86 of the abrasive compact layer 80 provides an abrasive surface for the body, while the peripheral edge 88 provides a cutting edge, remote from the interface 84.

Two abrasive compact projections 90 extend from the interface 84 into the substrate 82. The projections are each elliptical in shape, in plan, as can be seen from FIG. 5. Both projections lie wholly within the outer surface 92 of the abrasive body. Each projection has an elliptical flat base 94 and sides 96 which slope to the interface 84.

Figure 4:
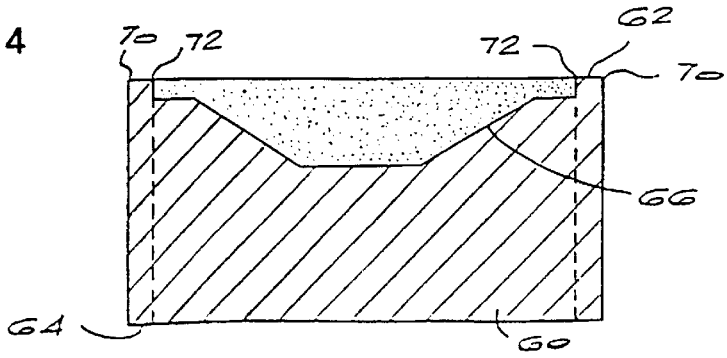
FIG. 4 is a sectional side view of a second embodiment of the invention.

The abrasive bodies described above may be made by methods known in the art. Generally, this will involve providing a cylindrical shaped cemented carbide body having a recess, to receive the components necessary to make an abrasive compact, formed in one end thereof. An example of such a body, to produce an abrasive body of FIGS. 1 to 3, is shown in FIG. 4. Referring to this figure, a cemented carbide body 60 is of right-circular cylindrical shape having flat ends 62 and 64. A recess 66 is provided in the end 62. This recess is filled with the components necessary to make an abrasive compact. The thus produced unbonded assembly is placed in the reaction zone of a conventional high temperature/high pressure apparatus to form an abrasive compact of the components which bonds to the body 60. The abrasive body illustrated by FIGS. 1 to 3 is produced by simply removing the sides of the body 60, as illustrated by the dotted lines. However, the bonded body which is recovered from the reaction zone after compact formation and without removal of the carbide sides, may be used as a tool insert itself, and forms another aspect of the invention. In this form of the insert, the edge 70 will provide the cutting edge. This edge is likely to wear away fairly rapidly until the abrasive compact edge 72 is reached. Thereafter it is this edge 72 which provides the cutting edge for the component.

The provision of the projections in the abrasive bodies of the invention result in an effective reinforcement and support for the cutting edge by providing overall rigidity for the bodies. Further, in use the cutting edges in the regions of the surfaces 52 of the projection for the FIGS. 1 to 3 embodiment and in the region 98 for the FIGS. 5 to 7 embodiment will generally be employed. The extra abrasive available in these regions increases effectiveness of the abrasive action of the body.

What is claimed is:

1. An abrasive body, comprising:

a substrate; and an abrasive layer bonded to the substrate along an interface, the abrasive layer including a cutting edge, and at least one projection extending from the interface into the substrate, the at least one projection having an essentially elliptical or circular form in plan view, and having a profile which includes a substantially flat central portion and at least one connecting surface joining the central portion to the interface, and wherein the at least one connecting surface slopes towards the interface from the central portion.

2. The abrasive body according to claim 1, wherein the at least one projection lies wholly within an outer surface of the abrasive body.

3. The abrasive body according to claim 1, wherein a portion of the at least one projection is coincident with an outer surface of the abrasive body.

4. The abrasive body according to claim 1, wherein at least two projections are provided.

5. The abrasive body according to claim 1, wherein the abrasive layer is selected from an abrasive compact and a layer of diamond produced by chemical vapor deposition.

6. The abrasive body according to claim 1, wherein the substrate is a cemented carbide substrate.

7. The abrasive body according to claim 1, wherein the abrasive body has a right-circular cylindrical shape.

* * * * *